US006553194B2

(12) United States Patent
Thompson et al.

(10) Patent No.: US 6,553,194 B2
(45) Date of Patent: Apr. 22, 2003

(54) TONING STATION DRIVE CHAIN COVER ASSEMBLY

(75) Inventors: Paul E. Thompson, Webster, NY (US); Charles R. Winterberger, Honeoye Falls, NY (US); Kenneth M. Patterson, Hilton, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/734,956

(22) Filed: Dec. 11, 2000

(65) Prior Publication Data

US 2002/0071692 A1 Jun. 13, 2002

(51) Int. Cl.[7] ..... G03G 21/00; G03G 15/08

(52) U.S. Cl. ..... 399/98; 102/107

(58) Field of Search ..... 399/98, 102, 103, 399/119, 107, 222; 475/210

(56) References Cited

U.S. PATENT DOCUMENTS 5,128,709 A * 7/1992 Nagumo et al. ..... 399/98

FOREIGN PATENT DOCUMENTS

JP 4-295869 * 10/1992

* cited by examiner

*Primary Examiner*—Hoang Ngo

(57) ABSTRACT

An electrophotographic printer having an improved flexible drive chain cover located to protect the toning shell drive chain from contamination with toner dust. The electrophotographic printer may include a rigid drive chain cover located adjacent the flexible drive chain guard and locate so that the flexible drive chain guard and the rigid drive chain overlap.

12 Claims, 7 Drawing Sheets

TONING STATION DRIVE CHAIN COVER ASSEMBLY

BACKGROUND OF THE INVENTION

1. Field of the Invention

This invention relates to a drive chain cover for use on a toning station employed in electrophotographic printers and copiers. More particularly, this invention relates to a drive chain cover assembly used to protect the toning station drive chain from contact with toner, which may cause damage to the drive chain, resulting in shortened useful chain life.

2. Brief Description of the Related Art

Throughout this disclosure, the term "electrophotographic printer" is to be construed to include printers and copiers employing electrophotographic means for image production. Electrophotographic printers that utilize a dry ink toner-based developer include a toning station having a toning shell that is used to transport the developer mix to an image development area where the toner is applied to a photoconductor that carries an electrostatic image. The toner interacts electrostatically with the photoconductor, temporarily bonding to the photoconductor before being transferred to the paper.

Typically, the toning shell is driven by means of a chain driven by a sprocket affixed to a shaft that ultimately is driven through gear box actuated by the main drive of the copier. Such drive chains are typically made of polymeric material, encasing pins that contact the cogs on the drive sprockets. In order to maintain appropriate chain tension, it is important that the drive chain remain flexible. However, contact with toner can damage the polymeric materials from which the drive chains are constructed, causing the chain to stiffen, dramatically limiting its usefulness and shortening the useful life of the chain, requiring its early replacement. Unfortunately, the drive chains necessarily reside in an environment in which contact with toner is a high probability. Although the toner is contained in a large toner reservoir, toner may be spilled by the printer operator when replacing the toner reservoir, and such spilled toner falls directly onto the drive chains. Additionally, during normal operation of the equipment, toner dust migrates from the development area of the printer, driven by air currents created by moving parts of the equipment. Thus, toner dust naturally migrates out of the image development area and into the open areas of the toning station, ultimately contacting the drive chains. Modifications to the toning station to minimize the amount of toner spillage and migration may be expensive and not feasible, given space constraints inside the printer.

Additionally, many toning stations open, with an upper portion pivoting away from a lower portion about a hinge joint, to allow for cleaning and maintenance of the toning station components. Any device used to protect the chains from contact with toner dust must therefore be compatible with opening the toning station, by physically permitting the upper portion of the station to pivot with respect to the lower portion of the station, and by not dumping accumulated toner dust onto the drive chains when the toning station is opened. Therefore, there is a need in the art for an improved means of protecting the drive chains from contact with toner dust.

SUMMARY OF THE INVENTION

The present invention solves these and other shortcomings of the prior art by including a flexible chain guard that covers the main toning station drive chain, shielding the chain from toner spills and directing the toner away from the chain when the toning station is opened. The flexible chain guard also works in conjunction with a rigid, fixed chain guard to shield the drive chains and drive sprockets from excessive toner dust contamination.

One embodiment of the present invention is an electrophotographic printer that includes a toning station having a rotating toning shell driven by at least one drive chain. A photoconductor is located in close proximity to the toning shell, defining an image development area therebetween. A flexible drive chain cover is located adjacent the image development area.

In another embodiment, at least a portion of the flexible drive chain cover is substantially planar, and includes a seal area located immediately adjacent the image development area, the seal area made from a fibrous material, such as felt, and engaging the photoconductor to reduce toner migration out of the image development area.

In a further embodiment, the electrophotographic printer also includes a rigid drive chain cover located adjacent the flexible drive chain cover, such that the rigid and flexible drive chain covers overlap. The rigid drive chain cover may be located on a toner replenisher assembly located adjacent the toning station.

In a further embodiment, the toning station includes an upper portion and a lower portion, connected by a hinge, the upper portion pivoting on the hinge to separate from the lower portion to provide access to the lower portion. The flexible drive chain cover is located adjacent the drive chain and remains adjacent the drive chain when the upper portion of the toning station is pivoted with respect to the lower portion of the toning station. The flexible drive chain cover flexes to allow the upper portion of the toning station to pivot with respect to the lower portion of the toning station.

DETAILED DESCRIPTION OF THE DRAWINGS AND PREFERRED EMBODIMENTS

Figure 1A:
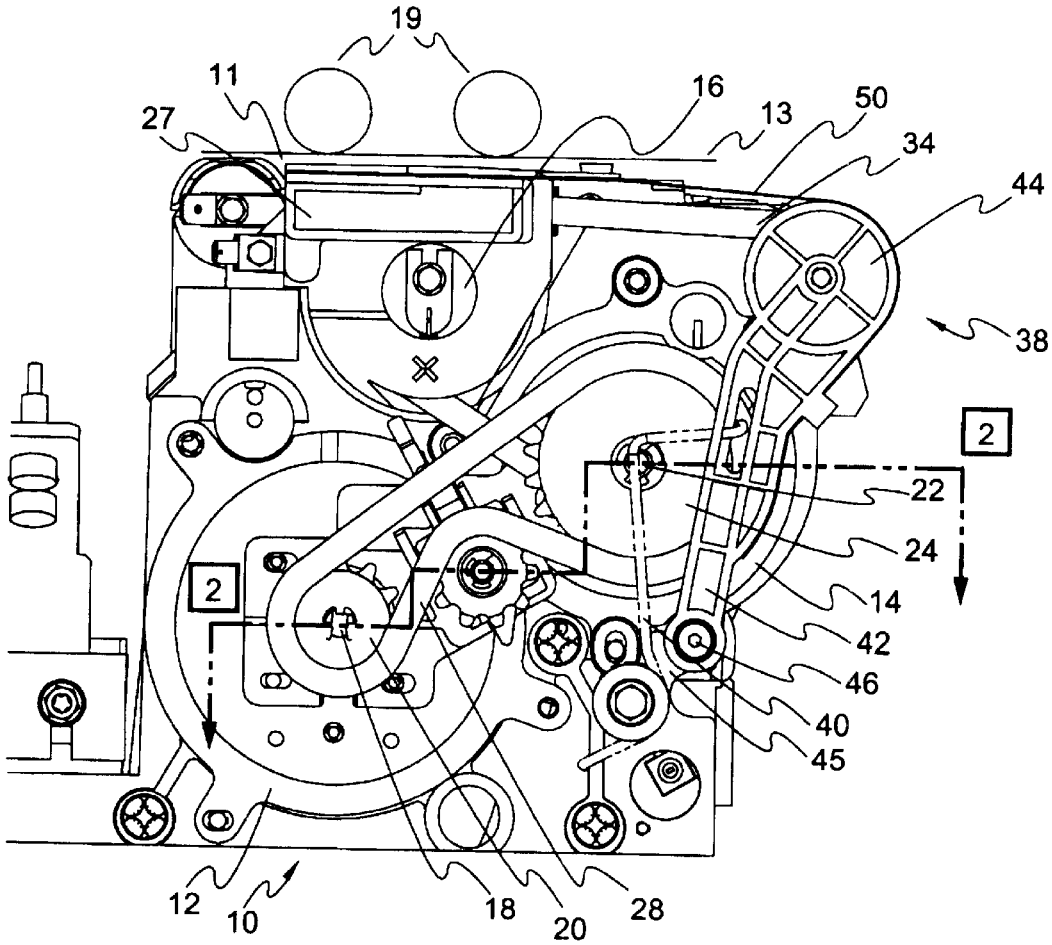
FIG. 1A is a side view of a toning station of the present invention.
Figure 1B:
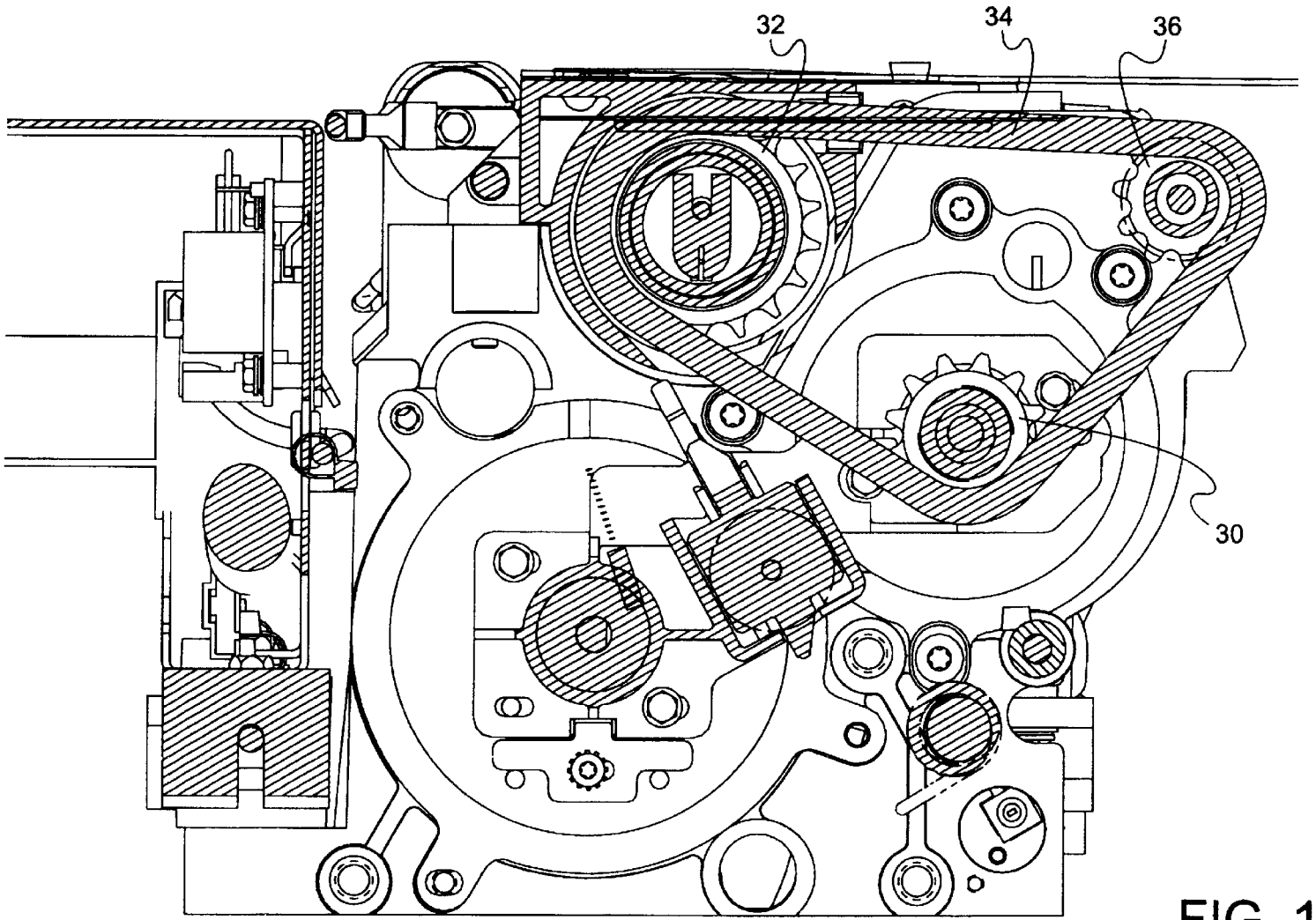
FIG. 1B is a partial cross-sectional view of the toning station, with the intermediate drive chain and sprockets removed to show the primary drive chain and sprockets.
Figure 2:
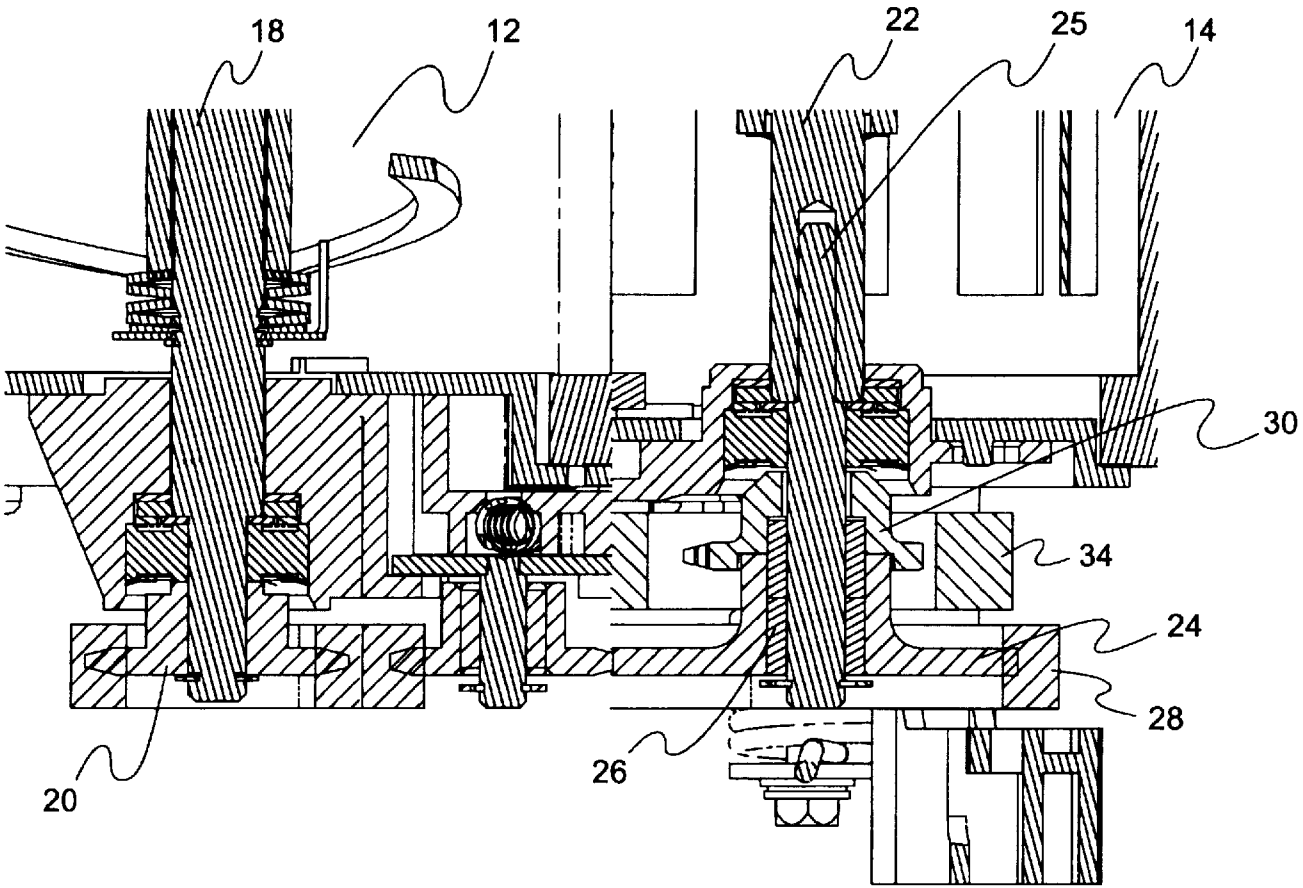
FIG. 2 is cross-sectional view of the toning station taken along line 2—2.
Figure 3:
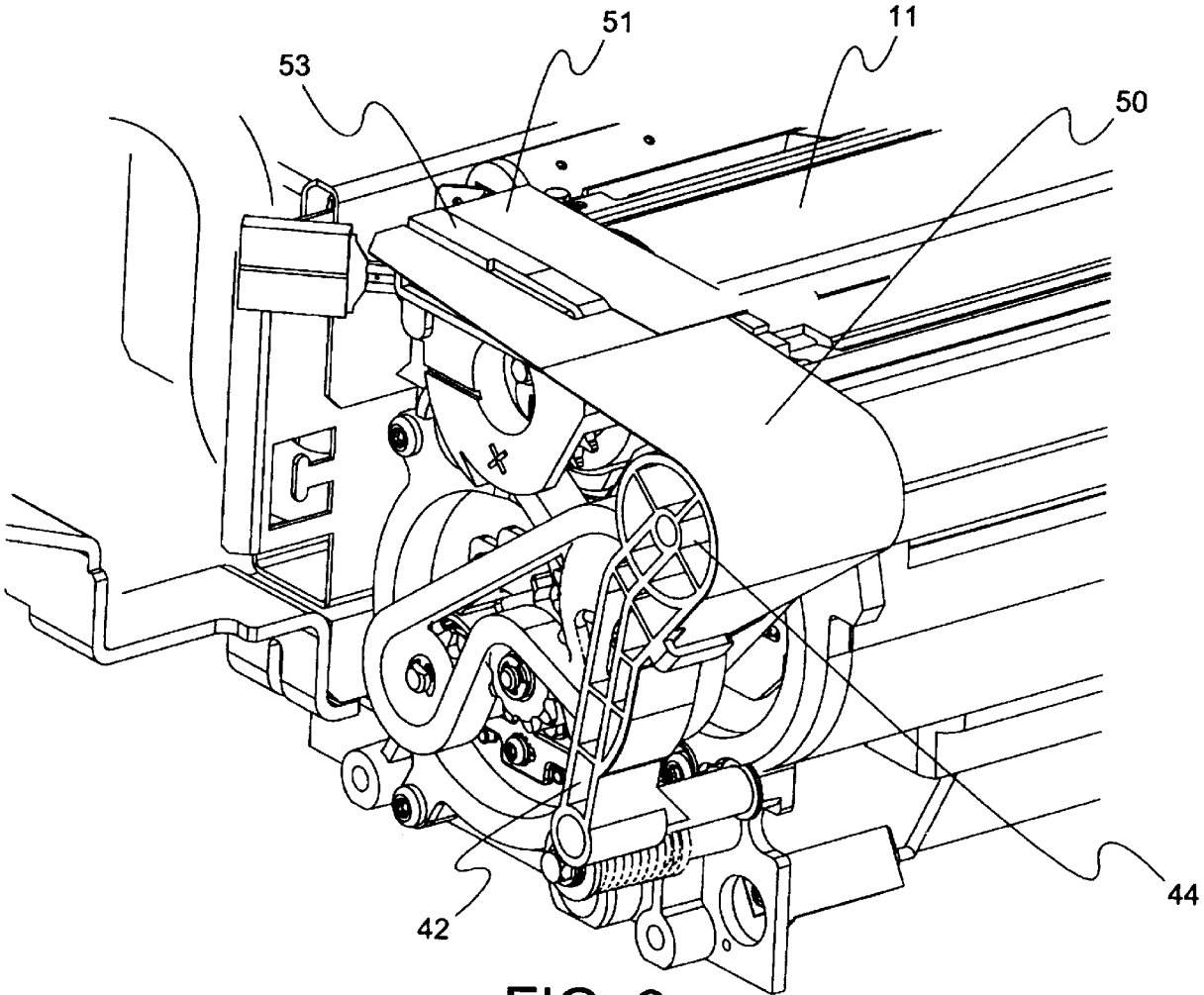
FIG. 3 is an is an isometric view of a toning station employing a flexible chain guard of the present invention.

Referring to FIGS. 1A, 1B and 2, a typical toning station 10 of the type employing the present invention includes a developer blender 12 and a developer delivery bucket 14. Toner is delivered to the blender 12 through a toner replenisher aperture 15, and is mixed in the blender 12 with a particulate carrier to yield a two-component developer. The blended developer spills over into the bucket 14, and the bucket rotates to deliver developer to the toning shell 16, which, in turn, applies toner to a photoconductor 13, such as a rotating film loop, for ultimate transfer to the paper on which the printed image is formed. The photoconductor 13 is biased into close proximity to the toning shell 16 by at least one and preferably two film back-up bars 19, that are actuated to apply downward pressure on the photoconductor 13 to move the photoconductor into the appropriate position with respect to the toning shell 16. The downward movement of the back-up bars 19 can create a pressure differential that results in toner dust being "puffed" out of the development area 11, i.e., the area in which the toning shell 16 and the photoconductor 13 are in close proximity.

Rotation of the toning shell 16 is driven by at least one drive chain and, in the preferred embodiment depicted in FIGS. 1 and 2, the toning shell is driven by two drive chains. Although the following description relates to a preferred embodiment that includes primary and intermediate drive chains, many printers employ a single drive chain, in the position of the primary drive chain 34. It is to be understood that the invention is equally applicable to printers having one, two or more drive chains.

The blender 12 is driven by a blender shaft 18 that passes through the blender 12 axially, and is ultimately driven through a gear box connected to the main drive motor of the printer (not shown). Affixed to an end of the blender shaft 18 is a first intermediate drive sprocket 20. Likewise, the bucket 14 is driven by an axial bucket shaft 22. A second intermediate drive sprocket 24 rotates on a needle bearing 26 relative to an auxiliary bucket shaft 25, which is press fit into an end of the bucket shaft 22. The needle bearing 26 is seated in a recess in the bucket shaft 22. Thus, the second intermediate drive sprocket 24 is not driven by the bucket shaft 22, but rather merely idles on the end of the bucket shaft 22 and is driven by an intermediate drive chain 28 that passes around and over the first and second intermediate drive sprockets 20, 24. Accordingly, the rotation of the first intermediate drive sprocket 20, imparted by the blender shaft 18, is transmitted to the second intermediate drive sprocket 24 by the intermediate drive chain 28.

A primary drive sprocket 30 is affixed to the second intermediate drive sprocket 24, and, therefore, the second intermediate drive sprocket 24 directly drives the primary drive sprocket 30. The primary drive sprocket 30 drives a toning shell drive sprocket 32 by means of a primary drive chain 34. The primary drive chain 34 is tensioned by a primary tensioner sprocket 36 affixed to an tension arm 38 having an tension arm shaft 42 and cylindrical tension arm head 44. The tension arm 38 is affixed to the toning station frame 45 at a lower end 46, and is free to rotate about this attachment point. Since the tension arm 38 is biased outwardly by an tension spring 40, rotation at the lower end 46 of the tension arm 38 tensions the primary drive chain 34.

Referring to FIGS. 1A–6, the primary drive chain 34 is directly exposed to both spillage of toner upon changing the toner bottle (no shown) and migration of toner dust out of the image development area 11 on operation of the printer. Accordingly, a flexible chain guard 50 is interposed between these sources of toner dust and the primary drive chain 34. The flexible chain guard is best seen by reference to FIG. 3. The flexible chain guard 50 originates at and is affixed to the tension arm shaft 42 and passes around and over the cylindrical tension arm head 44, continues over the entire length of the primary drive chain 34, and terminates at and is affixed to the end block housing 27. The flexible chain guard 50 is positioned such that its width overlaps the development area in which toner is applied to a photoconductor (not shown), and extends laterally to a position such that the primary drive chain 34 is shielded from toner dust originating above the drive chain 34. In this manner, the entire length of the primary drive chain 34 that may be exposed to toner dust is covered by the flexible chain guard 50.

Additionally, the flexible chain guard 50 includes a seal area 51 immediately adjacent the development area 11. Back-up bar pads 53 are affixed to the flexible chain guard immediately adjacent the seal area 51. The back-up bar pads 53 arrest the downward motion of the back-up bars 19 at a pre-set distance above the level of the toning shell 16, allowing the back-up bars 19 to force the photoconductor 13 into close proximity to the toning shell 16, but preventing the back-up bars 19 from exerting such pressure on the photoconductor 13 as to interfere with rotation of the photoconductor 13 or the toning shell 16. The seal area 51 is made of a fibrous material, such as felt, so that, as the back-up bars 19 force the photoconductor 13 downward to the level of the back-up bars 19, the fibrous nature of the seal area 51 makes light contact with the photoconductor 13, essentially creating a seal, preventing or reducing the migration of toner out of the development area 11.

The flexible chain guard 50 may be constructed of any suitable non-conductive material having sufficient flexibility. In a preferred embodiment, the flexible chain guard 50 is constructed from a General Electric polymer (GE VALOX FR-1, 0.010 inch thickness). The flexible chain guard may be affixed to the tension arm shaft 42 and end block housing 27 in any conventional manner, such as by adhesives, bolts, rivets and the like. In a preferred embodiment the flexible chain guard 50 is secured to the tension arm shaft 42 and to the end block 27 by double-sided adhesive tape.

Figure 4:
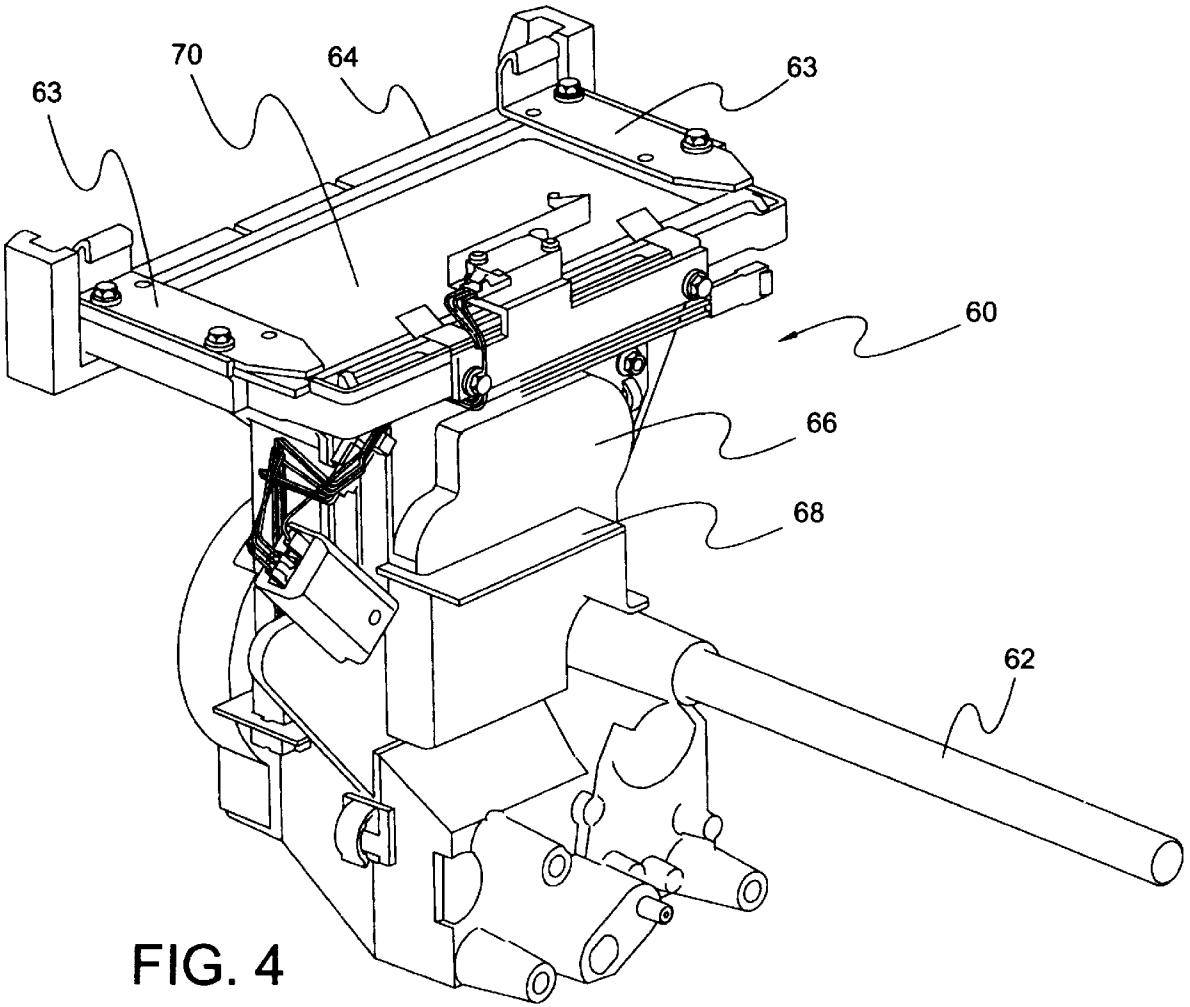
FIG. 4 is an isometric view of a toner replenisher assembly employing a rigid chain guard of the present invention.

Referring to FIG. 4, a toner replenisher assembly 60 includes a toner delivery tube 62 and a toner bottle receiving frame 64 that includes rails 63. A toner bottle (not shown) having a head specially adapted to interlock with the rails 63 is fitted into the receiving frame 64 to add toner to the replenisher assembly 60. As needed, toner is delivered through the toner delivery tube 62 into the blender 12. The gears (not shown) that drive the toner delivery tube 62 are covered and protected by a rigid gear cover 66. A rigid chain guard 68 is affixed to the gear cover 66. In a preferred embodiment, the rigid chain guard 68 is an integral part of the gear cover 66, as the gear cover 66 is molded with the rigid chain guard 68 as a part thereof.

Figure 5:
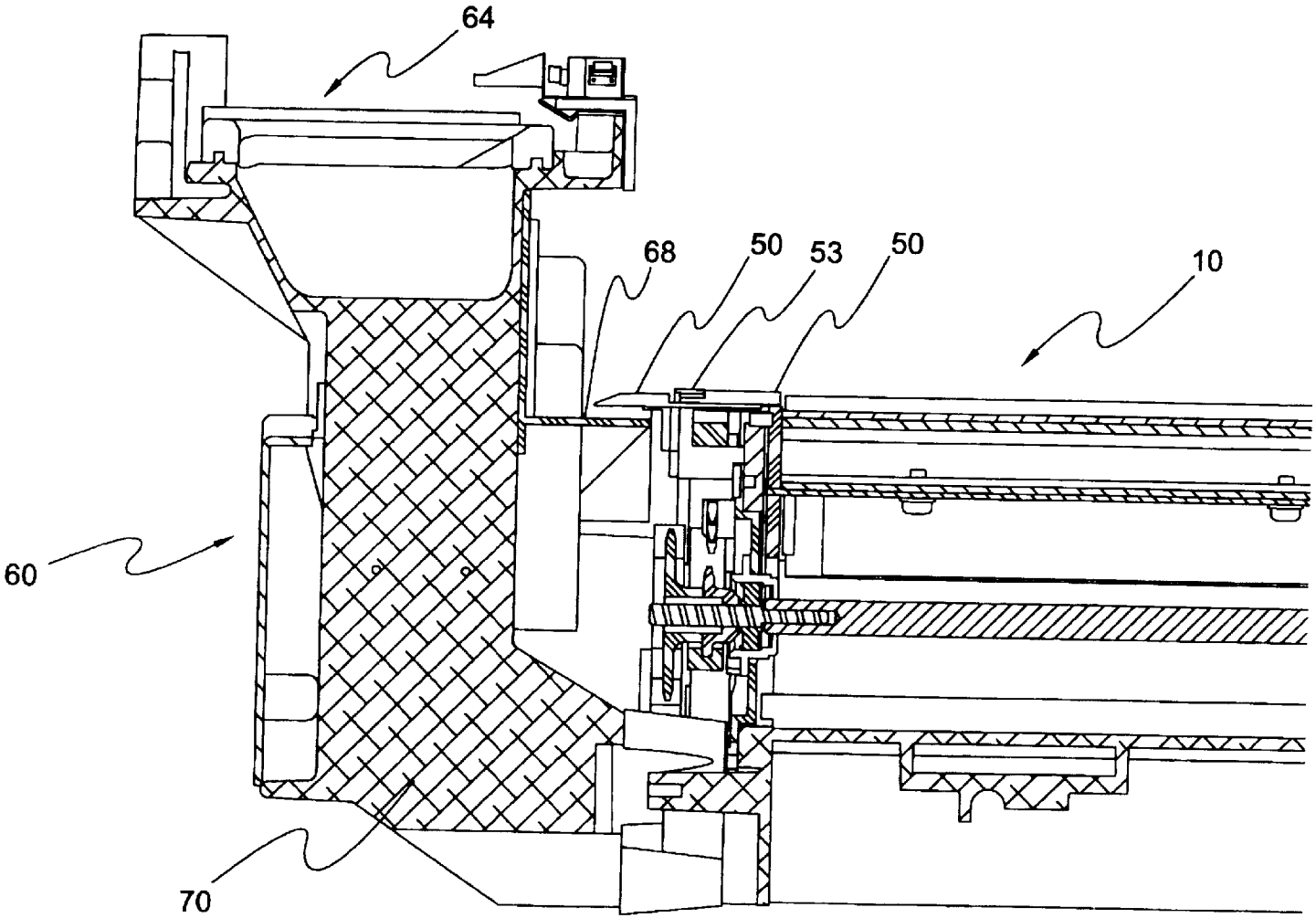
FIG. 5 is a side, cross-sectional view of a toner replenisher assembly mounted to a toning station employing rigid and flexible chain guards of the present invention.

Referring to FIG. 5, the rigid chain guard 68 is positioned such that it extends from the replenisher assembly 60 in the direction of the toning station 10, at a height sufficient to place the rigid chain guard 68 over the primary drive chain 34, thus shielding the primary drive chain 34 from toner dust. Furthermore, the flexible chain guard 50 overlaps the rigid chain guard 68, combining to prevent toner dust from contacting the primary drive chain 34.

Figure 6:
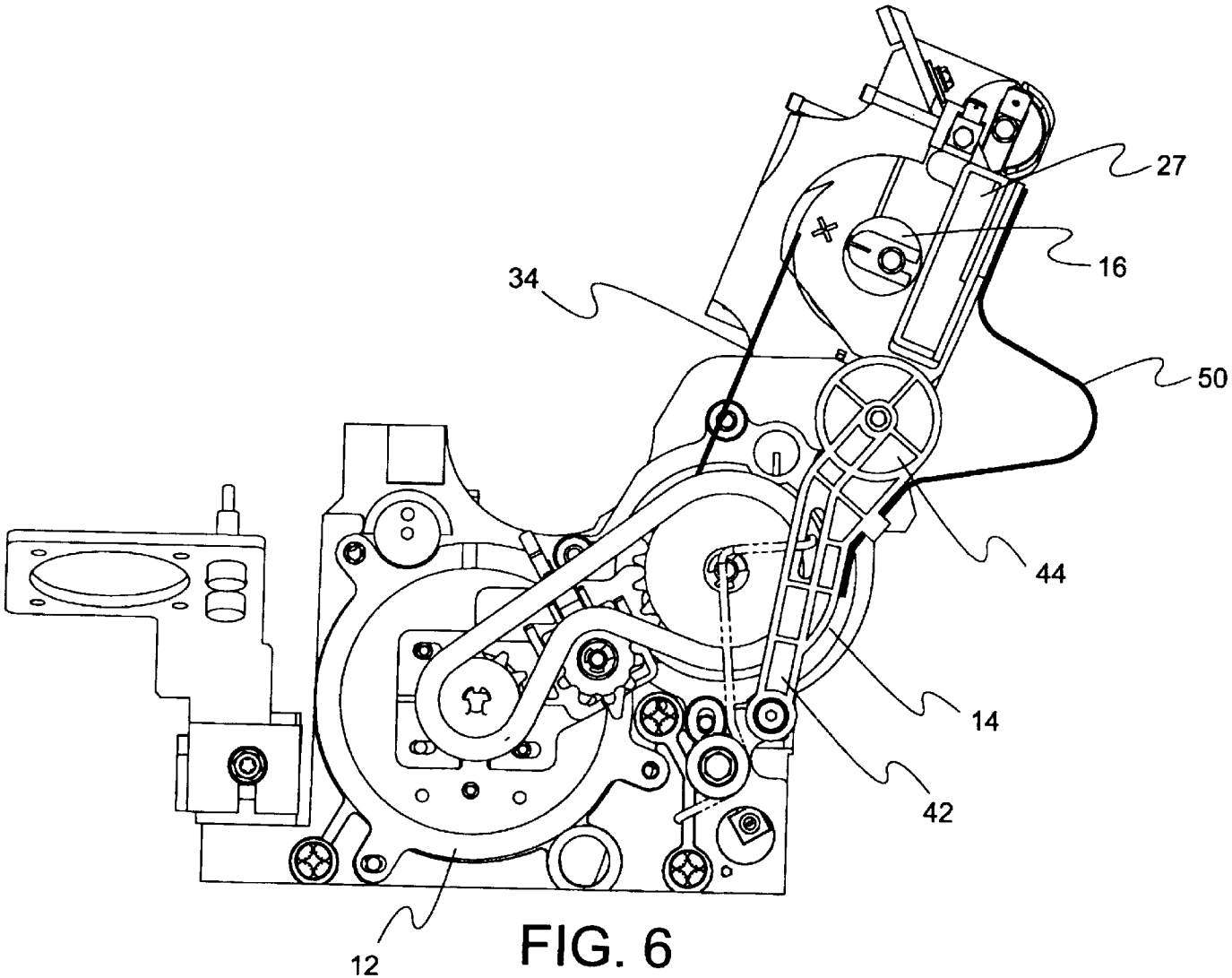
FIG. 6 is a side view of toning station in the open position, with an upper portion pivoted with respect to a lower portion.

FIG. 6 depicts a toning station 10 in the open position, illustrating the manner in which the flexible chain guard 50 is capable of depositing any loose toner dust away from the primary drive chain 34 when the toning station is opened for service or maintenance. When the toning station 10 is opened, the flexible chain guard 50 flexes to allow the upper portion of the toning station to pivot away from the lower portion of the toning station, without interference from the flexible chain guard 50. Additionally, the flexible chain guard 50 remains in position, covering the primary drive chain 34 at all times, directing any toner dust that may have accumulated on the flexible chain guard 50 over the cylindrical tension arm head 44 and away from the primary drive chain 34.

It is to be understood that the foregoing detailed description describes presently preferred embodiments of the invention and that other alternatives, which will become apparent to those of skill in the art upon reviewing the foregoing description, are likewise intended to fall within the scope of the appended claims, including equivalents thereto.

We claim:

1. An electrophotographic printer comprising:

a toning station, comprising a rotating toning shell, the toning shell driven by at least one drive chain;

a photoconductor in proximity to the toning shell, the toning shell and the photoconductor defining an image development area therebetween; and a flexible drive chain cover located adjacent the image development area, interposed between the image development area and the drive chain.

2. The electrophotographic printer of claim 1, wherein at least a portion of the flexible drive chain cover is substantially planar, and comprises a seal area located immediately adjacent the image development area, the seal area comprising a fibrous material that engages the photoconductor to reduce toner migration out of the image development area.

3. The electrophotographic printer of claim 2 wherein the fibrous material of the seal area is felt.

4. The electrophotographic printer of claim 1, further comprising a rigid drive chain cover located adjacent the flexible drive chain cover, such that the rigid and flexible drive chain covers overlap.

5. The electrophotographic printer of claim 4, wherein the rigid drive chain cover is located on a toner replenisher assembly located adjacent the toning station.

6. The electrophotographic printer of claim 1, the toning station comprising an upper portion and a lower portion, the upper portion and lower portion connected by a hinge, the upper portion pivoting on the hinge to separate from the lower portion to provide access to the lower portion; and the flexible drive chain cover is located adjacent the drive chain and remains adjacent the drive chain when the upper portion of the toning station is pivoted with respect to the lower portion of the toning station.

7. The electrophotographic printer of claim 6, wherein the flexible drive chain cover flexes to allow the upper portion of the toning station to pivot with respect to the lower portion of the toning station.

8. An electrophotographic printer toning station, comprising:

a rotating toning shell, the toning shell driven by at least one drive chain;

a photoconductor in proximity to the toning shell, the toning shell and the photoconductor defining an image development area therebetween; and a flexible drive chain cover located adjacent the image development area interposed between the image development area and the drive chain.

9. An electrophotographic printer comprising:

a toning station, comprising a rotating toning shell, the toning shell driven by at least one drive chain;

a photoconductor in proximity to the toning shell, the toning shell and the photoconductor defining an image development area therebetween;

a toner replenisher assembly located adjacent the toning station;

a flexible drive chain cover affixed to the toning station adjacent the image development area interposed between the image development area and the drive chain; and a rigid drive chain cover located affixed to the replenisher assembly, the rigid drive chain cover located adjacent the flexible drive chain cover, such that the rigid and flexible drive chain covers overlap.

10. The electrophotographic printer of claim 9, the toning station comprising an upper portion and a lower portion, the upper portion and lower portion connected by a hinge, the upper portion pivoting on the hinge to separate from the lower portion; and wherein the flexible drive chain cover flexes to allow the upper portion of the toning station to pivot with respect to the lower portion of the toning station.

11. A toning station drive chain cover assembly, comprising a flexible drive chain cover located adjacent a toning station drive chain to reduce toner contact with the drive chain.

12. A toning station drive chain cover assembly, comprising:

a flexible drive chain cover located adjacent a toning station drive chain to reduce toner contact with the drive chain; and a rigid drive chain cover located adjacent the flexible cover, such that the flexible drive chain cover and the rigid drive chain cover overlap.

* * * * *